United States Patent [19]

Compton

[11] 4,191,093

[45] Mar. 4, 1980

[54] CONCRETE STRIKE-OFF VIBRATOR

[76] Inventor: Marshall F. Compton, 114 Brandon, Conroe, Tex. 77301

[21] Appl. No.: 834,297

[22] Filed: Sep. 19, 1977

[51] Int. Cl.[2] ..... F01L 21/02; F16J 11/02

[52] U.S. Cl. ..... 91/234; 92/169

[58] Field of Search ..... 91/234

[56] References Cited

U.S. PATENT DOCUMENTS

| | | | |
|---|---|---|---|
| 1,585,740 | 5/1926 | Saulia | 91/234 |
| 1,940,388 | 12/1933 | Callahan | 91/234 |
| 2,536,595 | 1/1951 | Dittmann | 91/234 |
| 2,607,569 | 8/1952 | Pierre | 91/234 |
| 2,797,664 | 7/1957 | Swanson | 91/234 |
| 2,861,548 | 11/1958 | Burgess, Jr. et al. | 91/234 |

*Primary Examiner*—Paul E. Maslousky

[57] ABSTRACT

A concrete strike-off vibrator is characterized by a manifold member having at least one cylinder assembly disposed in a force-transmitting relationship therewithin. The manifold includes a pressurized fluid inlet adapted to introduce a pressurized fluid into the interior volume of the manifold. The cylinder assembly includes a piston adapted to define first and second volumes within the cylinder assembly and has associated therewith an intake for introducing pressurized fluid from the interior volume of the manifold into the first and second volumes defined within the cylinder assembly. Included is an exhaust isolated from the intake and from the interior volume of the manifold for venting the first and the second volumes within the interior of the cylinder assembly.

7 Claims, 6 Drawing Figures

FIG.3
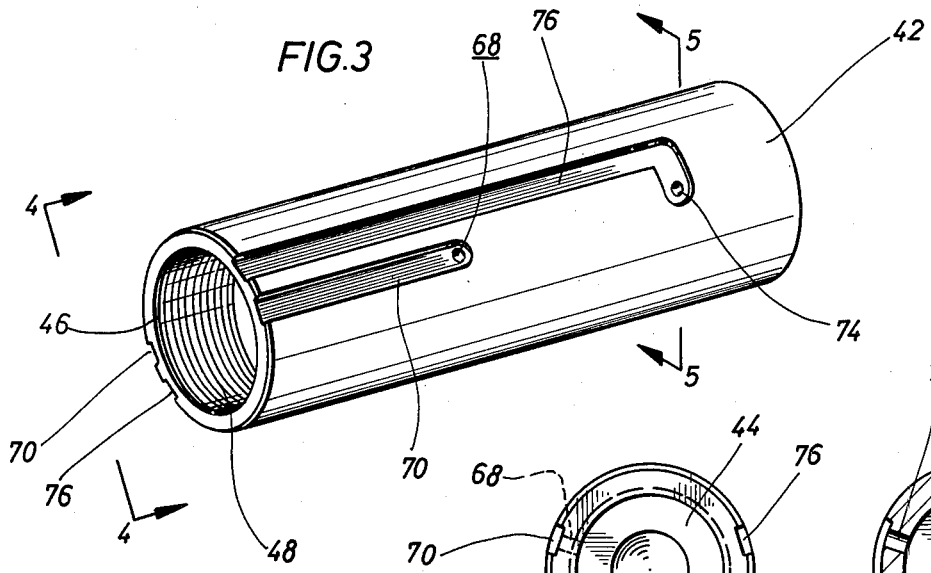
FIG.4
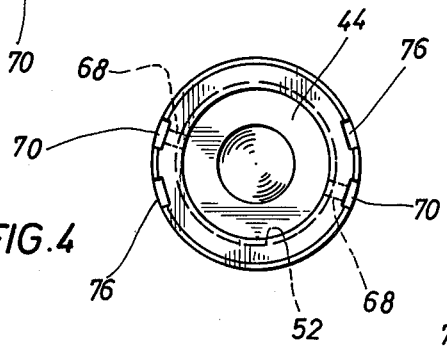
FIG.5
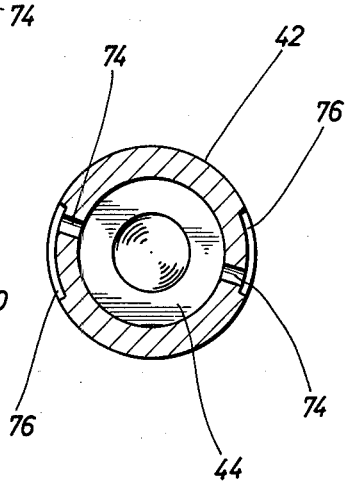
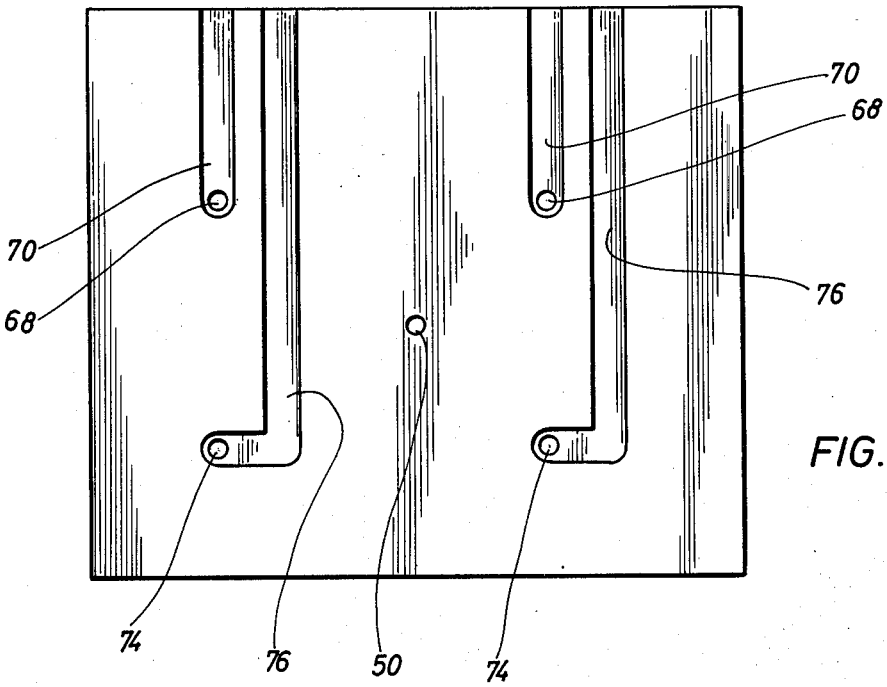
FIG.6

CONCRETE STRIKE-OFF VIBRATOR

BACKGROUND OF THE INVENTION

1. Field of the Invention

This invention relates to concrete strike-off vibrators and in particular, to a concrete strike-off vibrator having a pressurized fluid manifold communicating with the interiors of each of a plurality of cylinder assemblies disposed in a force-transmitting relationship within the manifold.

2. Description of the Prior Art

After a section of concrete has been layed, it is desirable to level the surface of that concrete to eliminate any undulations or discontinuities in the surface thereof. For this purpose the prior art utilizes a device known as a strike-off vibrator or a "crazy board". The strike-off vibrator is an elongated member having a flat strike-off surface thereon which is placed in contact with the upper surface of the concrete to be leveled. A plurality of fluid actuated piston-cylinder assemblies are mounted on the elongated strike-off member with each piston-cylinder assembly being provided with a separate pressurized fluid supply line.

A piston is disposed with each of the enclosed cylinders and moves within the cylinders in response to the introduction of pressurized fluid thereinto. The reaction forces generated by the collision of the piston member within the cylinder assemblies in response to the introduction of pressurized fluid is imparted to the elongated strike-off member and transmitted thereby to the concrete. The concrete responds to the vibratory motion of the stike-off member and undulations and discontinuities in the surface of the concrete are eliminated after passage of the strike-off vibrator thereover.

Current vibrators require, as discussed above, separate fluid inlet lines connecting a source of pressurized fluid, usually pressurized air, to each of the plurality of piston-cylinder assemblies disposed along the strike-off member. Such separate and independent fluid connections are disadvantageous, however, because of the unnecessary complexity of interconnections that is generated thereby. Furthermore, in practice it has been observed that individual ones of the fluid inlet lines have a tendency to separate themselves from their associated piston-cylinder assembly so that the introduction of pressurized fluid into that piston-cylinder assembly is terminated. Such an occurrence has the effect of reducing the vibratory motion and forces generated by the strike-off vibrator with a concommitant reduction in the efficiency of the leveling of the concrete.

It would be advantageous, therefore, to eliminate the heretofore complex fluid connection arrangements necessitated by the prior art. Accordingly, it is of advantage to provide a concrete strike-off vibrator utilizing a manifold member having an interior volume adapted to receive pressurized fluid thereinto. Furthermore, it is advantageous to provide a manifold adapted to receive a plurality of individual piston-cylinder assemblies therewithin in a force-transmitting relationship, each piston-cylinder assembly being interchangeably mounted and communicable with the interior of the manifold so that only a single pressurized fluid inlet is required to supply pressurized fluid to each piston-cylinder assembly associated with the strike-off.

SUMMARY OF THE INVENTION

This invention relates to a concrete strike-off vibrator which includes a manifold member having an internal volume and a pressurized fluid inlet adapted to permit the introduction of pressurized fluid thereinto. At least one but preferably a plurality of cylinder assemblies is disposed in interchangeable and threaded force-transmitting relationship with said manifold. Each of the cylinder assemblies includes a piston adapted to define a first and a second volume within the cylinder assembly. Intake means for introducing a pressurized fluid from the interior volume of the manifold into each of the first and second volumes defined by the piston within the cylinder assembly is provided. Furthermore, exhaust means isolated from the interior volume of the manifold and from the intake means communicate with each of the first and the second volumes of each cylinder assembly to vent fluid therefrom.

BRIEF DESCRIPTION OF THE DRAWINGS

The invention will be more fully understood from the following detailed description thereof, taken in connection with the accompanying drawings, which form a part of this specification and in which:

FIG. 3 is an isolated perspective view of a portion of a cylinder assembly embodying the teachings of this invention;

FIG. 4 is an end view of the portion of the cylinder assembly taken along lines 4—4 in FIG. 3;

FIG. 5 is a sectional view of the portion of the cylinder assembly taken along section lines 5—5 of FIG. 3; and, FIG. 6 is a fully developed of the portion of the cylinder assembly shown in FIG. 3.

DESCRIPTION OF THE PREFERRED EMBODIMENT

Figure 2:
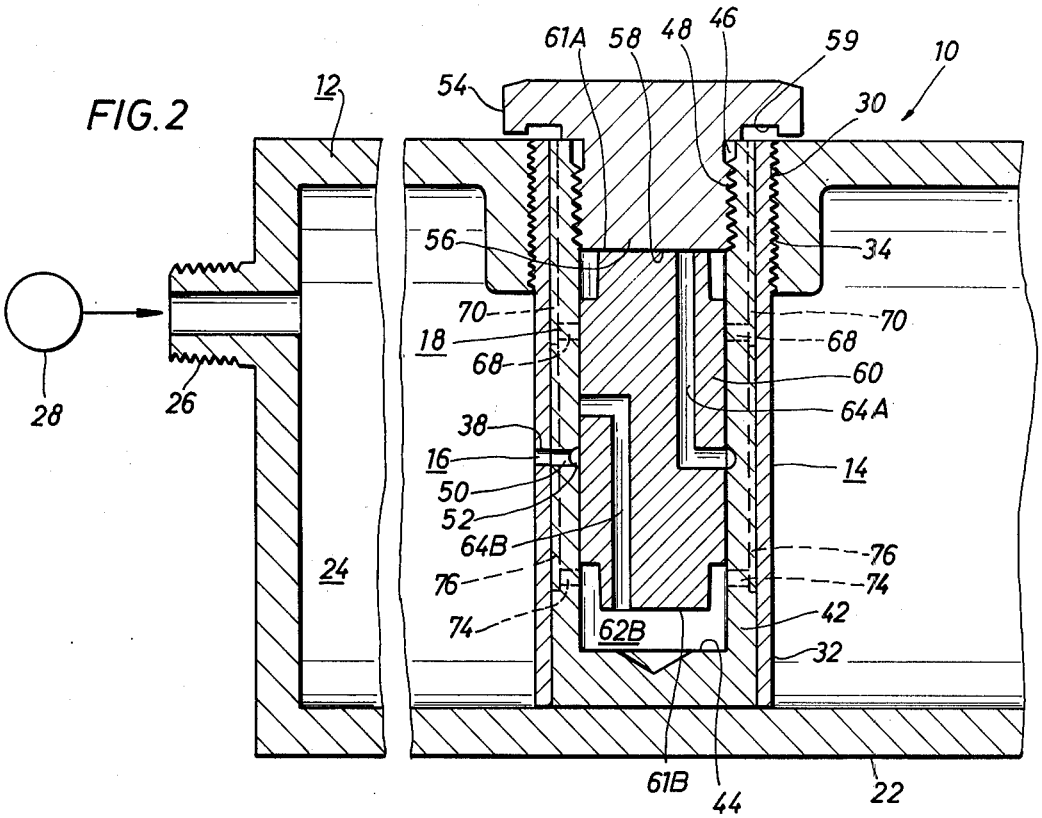
FIGS. 1 and 2 are elevational views, entirely in section, of a concrete strike-off vibrator embodying the teachings of this invention.

Throughout the following description similar reference numerals refer to similar elements in all figures of the drawings.

Figure 1:
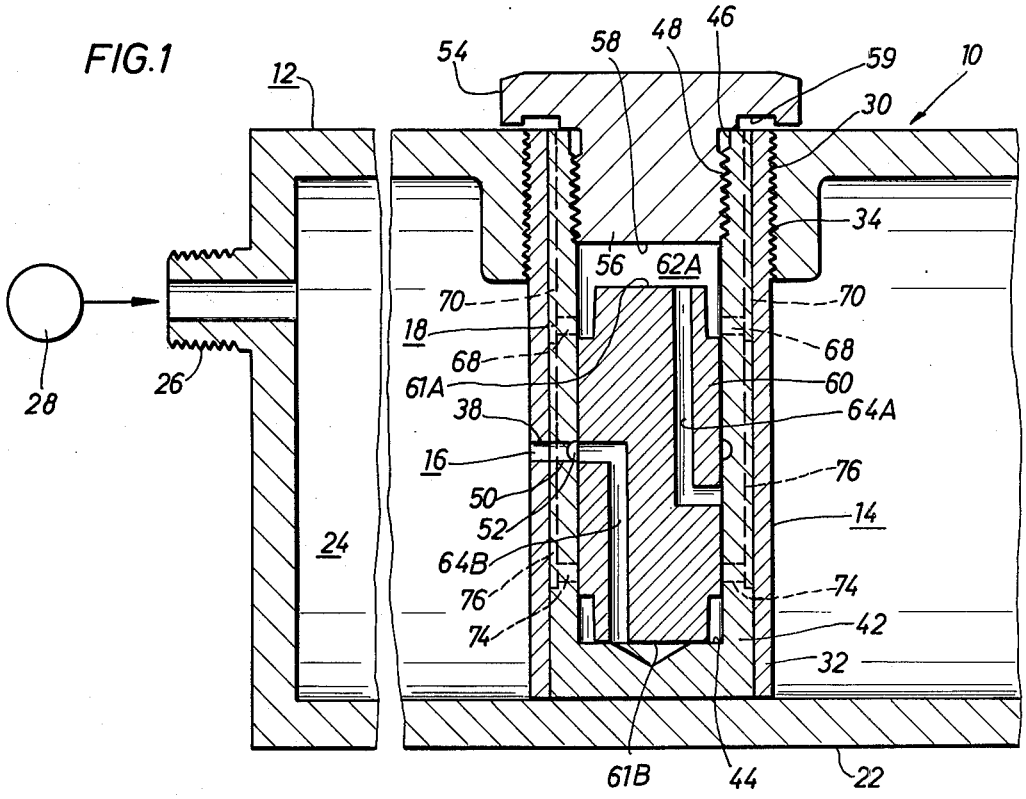

Referring to FIGS. 1 and 2, elevational views entirely in section of a concrete strike-off vibrator 10 embodying the teachings of this invention are illustrated. The vibrator 10 includes generally a manifold member 12 having a plurality of cylinder assemblies generally indicated by reference numeral 14 disposed in a force-transmitting relationship therewithin. For clarity, only one cylinder assembly 14 is illustrated in FIGS. 1 and 2, yet it is understood that any predetermined number of such cylinder assemblies 14 may be disposed within the manifold 12. Each cylinder assembly includes intake means generally indicated by reference numeral 16 for introducing prespressurized fluid from the interior of the manifold 12 into the cylinder assembly 14 and exhaust means generally indicated by reference numeral 18 for venting fluid from the interior of the cylinder assembly, the exhaust means 18 being isolated from the intake means 16 in a manner more clearly set forth herein.

It is understood that the manifold 12 is a generally rectangular elongated member having a contacting surface 22 adapted to engage the surface of a section of concrete so that discontinuities and imperfections in that concrete surface may be eliminated therefrom. The manifold member and contacting surface 22 thereof may be of any predetermined axial length, typically of a length coextensive with the section of concrete to be operated on thereby. The manifold member 12 defines an interior volume generally indicated by reference numeral 24, with a pressurized fluid inlet 26 being provided at any predetermined location on the manifold 12. The pressurized fluid inlet 26 is connected to a source 28 of pressurized fluid, typically compressed air, as indicated diagrammatically on FIGS. 1 and 2. With the connection provided between the source 28 of pressurized fluid and the inlet 26, it can be appreciated that the interior volume 24 of the manifold member 12 has fluid, as compressed air, disposed therein at a pressure substantially equal to the pressure of the source 28.

The cylinder assemblies 14 are disposed predetermined distances one from the other within the manifold member 12. Typically, to strike-off a 12 foot wide section of concrete, six cylinder assemblies 14 are utilized, with the spacing between cylinder assemblies 14 within the manifold member 12 being substantially equal. The manifold member 12 includes an upper surface having a plurality of threaded openings 30 therein. The threaded openings 30 are spaced predetermined distances apart in order to receive a cylinder assembly 14 in a manner to be made more clear herein.

Each of the cylinder assemblies 14 includes a substantially cylindrical sleeve 32 having a plurality of threads 34 disposed on the upper external surface thereof. The sleeve 32 of the cylinder assembly 14 has a radially extending fluid inlet port 38 provided therein for a purpose to be more clear herein.

Each of the cylinder assemblies 14 includes a barrel element 42 disposed concentrically within and in close-fitting relationship with the interior of the sleeve 32. The barrel 42 is an open-ended hollow cylindrical member having a bottom or lower impact surface 44 and an open end 46. Internally disposed threads 48 are provided adjacent the open end 46 of the barrel 42. The barrel 42 has a radial fluid inlet port 50 provided therein, the port 50 communicating with a circumferentially extending groove 52 disposed about the interior surface thereof. The fluid inlet ports 38 (in the sleeve 32) and 50 (in the barrel 42) register one with the other.

A flanged cap 54 having a threaded projection 56 thereon is adapted to be received within the internal threads 48 provided adjacent the open end 46 of the barrel 42. The cap 54 has an impact surface 58 thereon and a groove 59 on the underside of the head thereof. The cooperative association of the cap 54, threaded into the barrel 42, defines an enclosed volume bounded by the interior surface of the barrel 42, the impact surface 44, and the impact surface 58 on the interior of the cylinder assembly 14.

A free floating piston member 60 having upper and lower impact surfaces 61A and 61B, respectively, is provided within the interior volume of the cylinder assembly 14. In operation, the piston 60 is adapted to define first (upper) and second (lower) volumes 62A and 62B (respectively shown in FIGS. 1 and 2) on the interior of the cylinder assembly 14. The piston 60 includes a first and a second fluid conduit 64A and 64B, respectively. The conduit 64A communicates with the upper volume 62A while the conduit 64B is in fluid communication with the lower volume 62B.

The intake means 16 associated with each of the cylinder assemblies 14 comprises the radially registered fluid inlet ports 38 and 50 communicating with the circumferentially extending groove 52 on the interior of the barrel 42 and the fluid conduits 64 disposed within the piston 60. As the piston 60 moves within the enclosed volume on the interior of the cylinder assembly 14, one or the other of the fluid conduits 64 is alternately placed in communication with the groove 52 to thereby selectively permit the introduction of a pressurized fluid from the interior volume 24 of the manifold member 12 to the interior volumes 62A and 62B defined by the piston 60 within the cylinder assembly 14. The piston reacts to the pressurized fluid within the appropriate one of the volumes 62 by displacing within the cylinder to generate an impacting force between the corresponding impact surfaces on the piston and the cylinder.

The exhaust means 18 includes first and second passage arrangements provided within the barrel 42. With reference to FIGS. 1, 2 and 3, the passage arrangements included within the exhaust means may be best illustrated. The first passage arrangement includes a first plurality of substantially radially extending outlet ports 68 communicating with the first (upper) volume 62A (FIG. 1). Each of the fluid outlet ports 68 is in communication with one of a set of axially extending channels 70 provided on the exterior surface of the barrel 42. The second passage arrangement whereby the second (lower) volume 62B (FIG. 2) may be vented to a region external to the volume 24 of the manifold member 12 includes a second set of substantially radially extending fluid outlet ports 74 each of which communicates with a selected one of a plurality of axially extending channel 76 provided on the exterior surface of the barrel 42. As best seen in FIG. 3, the first passage arrangement (comprising ports 68 and channels 70) is isolated from and out of fluid communication with the second passage arrangement (comprising ports 74 and channels 76). Each of the passage arrangements comprising the exhaust means 18 conducts pressurized fluid from the respective one of the volumes 62 with which the passage arrangements are associated to a region, such as the atmosphere, external to the interior volume 24 of the manifold member 12.

As noted above, in the embodiment of the invention shown in FIGS. 1 and 2, the underside of the head of the flanged cap 54 has the circumferential groove 59 disposed therein. The groove 59 is in next axial adjacency to the ends or termini of the fluid outlet channels 70 and 76.

Having described a preferred embodiment of the invention the operation thereof is next discussed. To level a section of concrete, the concrete strike-off vibrator 10 embodying the teachings of this invention is disposed, in a quiescent condition across the width of a section of concrete to be leveled thereby with the contacting surface 22 disposed in contact with the surface to be leveled. Pressurized fluid from the source 28 thereof is conducted to the pressurized fluid inlet 26 to actuate of the strike-off 10. It is noted that a vibrator embodying the teachings of this invention utilizes and requires only one connection (usually a rubberized hose) between the source 28 of pressurized fluid and the manifold member 12. This is in contradistinction to the prior art strike-off vibrators which required a rubberized hose connection between each individual one of the cylinder assemblies mounted on the vibrator with the source of pressurized fluid. As pointed out above, the individual connections are disadvantageous in that they have a tendency to become loose or separated as well as being unduly complex when effecting connections and disconnections.

As with strike-offs in the prior art, vibratory force is generated and imparted to the contacting surface 22 by reaction forces generated by the contact of the piston surfaces 61A and 61B contacting respectively against the impact surface 58 of the cap 54 and the impact surface 44 of the barrel 42. Thus, reciprocal movement of the piston 60 within the volume defined on the interior of the cylinder assembly generates collisions between the upper and lower surfaces of the piston and the upper and lower surfaces of the cylinder. These collisions generate reaction forces which are transmitted to the manifold 12 and tend to vibrate the manifold 12 and the contacting surface 22 thereof. The vibratory forces generated in the manifold are transmitted through the contact surface 22 to level the concrete section over which it is disposed.

Through the provision of the strike off vibrator embodying these teachings, it may be appreciated that only one rubberized hose connection or the like is required in order to supply pressurized fluid to each of the cylinder assemblies. Introduction of pressurized fluid into the interior volume 24 of the manifold member 12 defines regions of pressurized fluid surrounding each cylinder assembly 14. Pressurized fluid is admitted into the volumes 62A and 62B defined above and below the piston 60 through the intake means 16 comprising registered fluid ports 38 (in the sleeve 32) and 50 (in the barrel 42), the groove 52 (disposed circumferentially about the interior surface of the barrel 42) and one or the other of the fluid conduits 64A or 64B. Communication of either of the conduits 64A or 64B with the circumferential groove 52 serves to admit pressurized fluid from the interior volume of the manifold member into the respective one of the volumes 62A or 62B with which the conduit 64 is associated. Thus, it may be appreciated that the piston 60 is reciprocated within the volume of the cylinder assembly 14 so as to generate reaction forces due to the forceful contact of the upper or lower surfaces of the piston with the upper and lower bounding surfaces of the cylinder.

Any damping effect generated by the presence of fluid within one or the other of the volumes 62 is eliminated by the venting of fluid trapped within a volume through the exhaust means 18. The exhaust means 18 comprises the sets of radial fluid ports 68 and 74 cooperating with the sets of channels 70 and 76 defined on the surface of the barrel 42. Thus, for example, in an upstroke (shown as movement of the piston 60 from the position shown in FIG. 1 to the position shown in FIG. 2), pressurized fluid admitted through the intake means 16 and the conduit 64B pressurizes the volume 62B urging the piston upwardly (as viewed in FIGS. 1 and 2). In order to eliminate the cushioning effect of fluid in the volume 62A as the piston 60 moves upwardly, fluid collected within the volume 62A is urged radially outwardly through the opposed fluid ports 68 by the approaching piston 60 and is conducted by the axially disposed channels 70 to the atmosphere or to a region external to the interior volume 24. In like manner, in a down stroke (shown as the movement of the piston from the position shown in FIG. 2 to the position shown in FIG. 1) pressurized fluid admitted through the intake means 16 including the conduit 64A pressurizes the volume 62A urging the piston downwardly (as viewed in FIGS. 1 and 2). To eliminate the cushioning effect of fluid trapped in the volume 62B the portion of the exhaust means 18 including the opposed radial ports 74 and substantially axial channels 76 conduct fluid present in the lower volume 62B to a region external of the interior volume 24 of the manifold 12.

It thus may be appreciated that a separate intake route is available to conduct pressurized fluid from the interior volume 24 into each of the volumes 62 disposed above and below the piston 60. Likewise, separate and isolated exhaust arrangements are provided to vent the appropriate volume 62 to a region external to the interior volume 24. The exhaust arrangements for the volumes 62 are isolated from communication one with the other and with the intake means 16. Further, the ports 68 or 74 associated with each of the volumes 62 are equiangularly disposed in communication with the volume vented thereby to prevent localized cushion effects due to the inefficient drainage of pressurized fluid from the volume.

Having described a preferred embodiment of this invention those skilled in the art may effect numerous modifications thereto in light of the description thereof herein-before recited. It is understood that those modifications remain within the contemplation of this invention as defined in the appended claims.

What is claimed is:

1. A concrete strike-off vibrator comprising:

a manifold having a presurrized fluid inlet adapted to permit the introduction of a pressurized fluid into a volume defined in the interior of said manifold;

a cylinder assembly disposed in a force-transmitting relationship within said manifold, said cylinder assembly including a piston adapted to define a first and a second volume within said cylinder assembly, said cylinder assembly comprising:

a barrel member having internal threads disposed adjacent the upper end thereof;

a flanged cap adapted for threaded interconnection with said barrel, said barrel and said cap cooperating to define an enclosed space wherein said piston is moveably disposed and from which said first and second volumes are defined;

a sleeve concentrically disposed in a close-fitting relationship about said barrel, said sleeve having external threads adapted for threaded interconnection with said manifold;

intake means for introducing a pressurized fluid from said interior volume of said manifold into said first and second volumes of said cylinder assembly; and, exhaust means isolated from said intake means and from said interior volume of said manifold for venting said first and said second volumes of said cylinder assembly;

said piston being displaceable within said cylinder assembly in response to the introduction of pressurized fluid into said first and second volumes of said cylinder assembly to generate vibratory forces transmissible to said manifold.

2. The concrete strike off vibrator of claim 1 wherein said exhaust means comprises:

a first passage arrangement and a second passage arrangement respectively adapted to permit communication between each of said first volume on the interior of said cylinder assembly and said second volume of said cylinder assembly and a region external to the interior volume of said manifold;

said first passage arrangement comprising a first set of substantially radially extending ports communicating with said first volume of said cylinder assembly and a first substantially axially extending set of channels provided on the external surface of said barel, said first set of channels communicating with said first set of radially extending ports; and said second passage arrangement comprises a second set of substantially radially extending ports communicating with said second volume of said cylinder assembly and a second substantially axially extending set of channels disposed on the external surface of said barrel and communicating with said second set of radially extending ports;

said first passage arrangement being isolated from said second passage arrangement.

3. The concrete strike-off vibrator of claim 2 wherein said intake means comprises:

a groove disposed circumferentially about the interior of said barrel and a radially extending fluid inlet port extending through said barrel in fluid communication with said groove; and a radially extending fluid inlet port extending through said sleeve, said inlet port in said sleeve being in radial registration with said inlet port through said barrel.

4. The concrete strike-off vibrator of claim 3 wherein said flanged cap has a groove on the underside thereof disposed in axial adjacency with the termini of said first and second set of axially extending channels.

5. The concrete strike-off vibrator of claim 2 wherein said flanged cap has a groove on the underside thereof disposed in axial adjacency with the termini of said first and second set of axially extending channels.

6. The concrete strike-off vibrator of claim 1 wherein said intake means comprises:

a groove disposed circumferentially about the interior of said barrel and a radially extending fluid inlet port extending through said barrel in fluid communication with said groove; and a radially extending fluid inlet port extending through said sleeve, said inlet port in said sleeve being in radial registration with said inlet port through said barrel.

7. The concrete strike-off vibrator of claim 6 wherein said flanged cap has a groove on the underside thereof disposed in axial adjacency with the termini of said first and second set of axially extending channels.

* * * * *